US005563360A

United States Patent [19]

Miyamoto et al.

[11] Patent Number: 5,563,360

[45] Date of Patent: Oct. 8, 1996

[54] AUTOMATIC PERFORMANCE APPARATUS CAPABLE OF REPETITIVE PERFORMANCE OF SPECIFIED PORTION

[75] Inventors: Hiromu Miyamoto; Hiroyuki Iwase, both of Hamamatsu, Japan

[73] Assignee: Yamaha Corporation, Hamamatsu, Japan

[21] Appl. No.: 172,090

[22] Filed: Dec. 22, 1993

[30] Foreign Application Priority Data

Dec. 25, 1992 [JP] Japan ..... 4-347350

[51] Int. Cl.[6] ..... G10H 7/00

[52] U.S. Cl. ..... 84/609

[58] Field of Search ..... 84/609–614, 634–638

[56] References Cited

U.S. PATENT DOCUMENTS

Re. 33,607 6/1991 Yuzawa et al. ..... 84/609

5,239,124 8/1993 Eitaki et al. ..... 84/634

5,274,192 12/1993 Kumagai ..... 84/637 X

FOREIGN PATENT DOCUMENTS 59-113491 6/1984 Japan .

3126085 5/1991 Japan .

*Primary Examiner*—Stanley J. Witkowski

*Attorney, Agent, or Firm*—Spensley Horn Jubas & Lubitz

[57] ABSTRACT

An automatic performance apparatus able to freely specify any two points A and B during the ALL repeat automatic performance. When the specified point A is closer to the start of the tune sequence being repeated than the point B, the apparatus repeats the performance between the two points A and B. When point B is closer to the start of the tune sequence, the performance skips from point B to point A.

17 Claims, 8 Drawing Sheets

| HEADER SECTION |
| --- |
| SONG DURATION |
| EVENT |
| SONG DURATION |
| EVENT |
| EVENT |
| SONG DURATION |
| ⋮ |
| END |
FIG.3
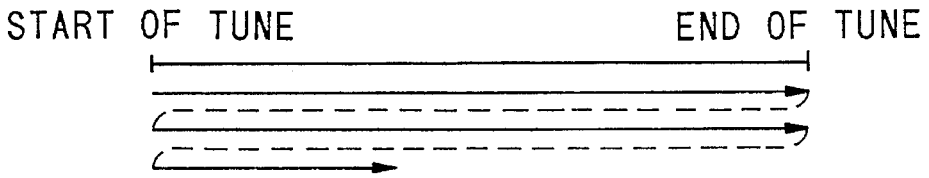
FIG.4(A)
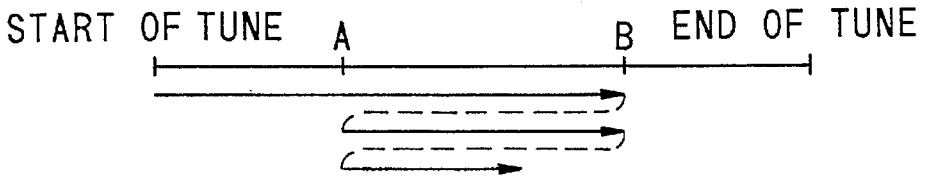
FIG.4(B)
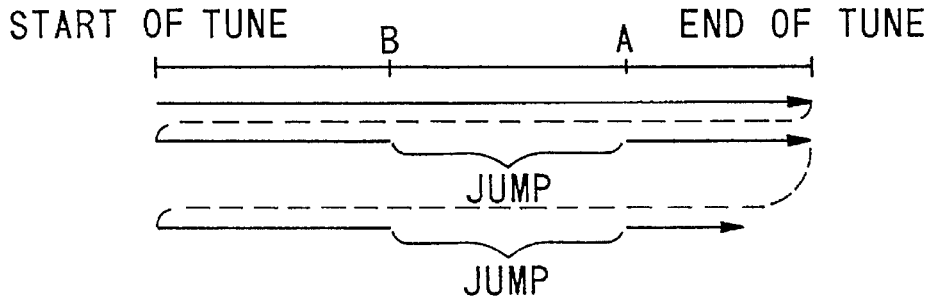
FIG.4(C)

AUTOMATIC PERFORMANCE APPARATUS CAPABLE OF REPETITIVE PERFORMANCE OF SPECIFIED PORTION

BACKGROUND OF THE INVENTION

1. Field of the Invention

The present invention relates to a musical apparatus which automatically repeats a certain specified tune sequence of a musical tune or automatically starts playing from a specified point in a musical tune sequence.

2. Technical Background

As is well known, there are many musical apparatuses which can automatically play a tune according to specified performance data. Among such apparatuses, there are some which can play all or part of the tune repeatedly, for example, Japanese Patent Application Laid-open Publication No. Sho 58-42093 discloses an apparatus which permits any part of a tune to be specified, and can repeatedly replay only the specified part of the tune.

In the apparatus shown in the above publication, the specified part is simply read out repeatedly, and there is no creativity in the manner of repetition, and the part of the musical tune is simply repeated many times over and over.

On the other hand, there is an automatic performance apparatus known to memorize a plurality of pattern data, and the order of playing the pattern data can be preprogrammed. However, this type of apparatus (pattern sequencer) could not repeatedly play any part of a tune, or start from any point in a tune.

SUMMARY OF THE INVENTION

The purpose of the present invention is therefore to present an automatic performance apparatus which is able to carry out a complex repeating performance, and although it is a pattern sequencer type, to freely start the performance from any location within a tune sequence.

The above objective is achieved in an apparatus comprising: an automatic performance apparatus for playing a tune by sequentially reading performance data stored in the memory device, comprising; a memory device for storing performance data in the order of a tune sequence; a readout device for repeatedly reading out performance data from the memory device in a given range of locations in said tune sequence; a location specifying device for freely specifying a first location and a second location to define a specific range of locations within said given range of locations; and a readout control device for moving the reading location of performance data, from said second location to said first location, when the reading location of the performance data read out by said readout device coincides with said second location.

According to such a construction of the apparatus, the memory device memorizes the performance data while the tune sequence is in progress; the readout device repeatedly reads out the performance data in the given range of locations of the tune sequence; the location specifying device freely specifies the first and second locations in the specified locations of the tune sequence; and when the reading location of the performance data reaches the second location, the readout control device moves the reading location of the performance data to the first position. By so doing, when the first location is specified closer to the start of the tune sequence than the second location, the repeat performance is carried out between the first and second locations. On the other hand, when the second location is specified closer to the start of the tune sequence than the first location, the performance skips the range of tune sequence bounded by the first and second locations.

In a variation of the embodiment, the first and second location can correspond to the start and the end of the tune, which means that the apparatus repeats the entire tune.

The apparatus also permits the first and the second locations to be specified while the automatic performance is being carried out.

The apparatus is provided with an address memory device so that when the reading location reaches the second location, the readout address is changed to the address of the second location.

The apparatus is also provided with a performance state memory device and reproduction device so that when the reading location is moved to the first location, the performance state, such as the tempo of the tune, at the first location is reproduced.

Another aspect of the present invention comprises: a first memory device for storing a plurality of pattern data consisting of a note event which represents a tone generation event and generation timing which represents the generation timing of said note event; a second memory device for storing song data which represents the order of performance of said plurality of pattern data in the order of said tune sequence; a readout device for reading out said song data in the order of said tune sequence from said second memory device, and for reading out pattern data from said first memory device in accordance with said song data; a location specifying device for freely specifying desired locations within said tune sequence; a third memory device for storing the memory location of song data in said second memory device to correspond with a specific location specified by said specifying device, and, based on the timing of said specific location, for deducing time data concerning a specific timing of the next pattern data immediately subsequent to said specific location, and storing said time data; a fourth memory device for storing the memory location of said pattern data in said first memory device to correspond with said specific location, and, based on the timing of said specific location, for deducing time data concerning a specific readout timing of the next note event immediately subsequent to said specific location, and storing said time data; and a readout control device for controlling the readout operations of said readout device in accordance with the memory locations and the time data stored in said third memory device and said fourth memory device.

According to a construction of the apparatus the first memory device memorizes a plurality of note events representing the tone generation and the generation timing of the note event; the second memory device memorizes the order of performance of the tune sequence to correspond with the progress of the tune as song data; the readout device reads out the song data successively from the second memory device; and the pattern data from the first memory device is read out from the first memory device in accordance with the song data. The location specifying device freely specifies locations within the tune sequence; the third memory device memorizes the memory locations of the sound data in the second memory device to correspond with the specific locations specified by the location specifying device; and at the same time, from the timing corresponding to the specified locations, decides the time related to a specified timing of the pattern data for the subsequent location of the specified location from the timing of the specified location, and memorizes it; the fourth memory device memorizes the memory location of the first memory device corresponding to the specific location of the pattern data in the specified locations, and decides the time related to the generation timing of the note event of the specified location immediately subsequent to the specified location from the timing corresponding to the specified timing, and memorizes it; and the control device controls the readout operation of the readout device in accordance with the memory locations and times memorized in the third and fourth memory devices. By so doing, embodiments of the present invention of automatic performance apparatus of the pattern sequencer type can carry out the performance from any specific location within the tune sequence.

Accordingly in embodiments of the present invention, automatic performance may be carried out in a complex way using any specified locations in the tune sequence, which way has not been available in the conventional apparatuses, such as in any range bounded between the specified locations, skip ping the range bounded by the specified locations, or starting the performance from the specified location.

Further in a pattern sequence type of apparatus which stores the order of performance of a plurality of pattern data, it is possible to carry out automatic performance from any specified location within a tune sequence.

BRIEF EXPLANATION OF THE DRAWINGS

FIG. 3 shows an example of the data format for the song data in the embodiment.

FIGS. 4(A)–(C) are an illustration of the repeated performance in the embodiment, in which FIG. 4 (A) is a repeated performance operation of one tune by ALL repeat; FIG. 4 (B) is a repeated performance by AB repeat; and FIG. 4 (C) is a skip performance by all repeat plus AB repeat operations.

PREFERRED EMBODIMENT

In the following, preferred embodiments of the present invention will be explained with reference to the drawings.

(A) Configuration of the Apparatus

Figure 1:
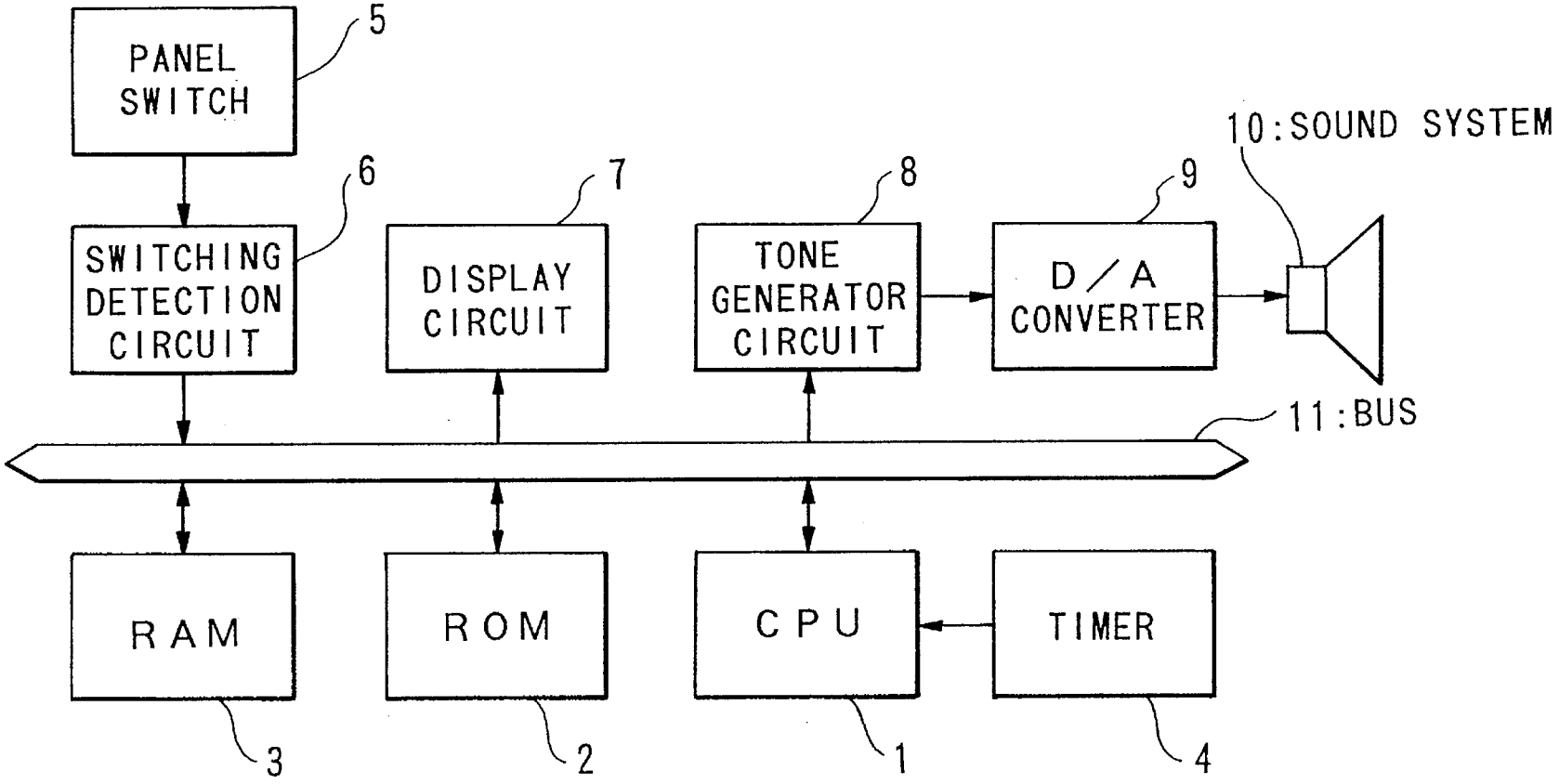
FIG. 1 shows a block diagram of the automatic music performance apparatus according to an embodiment the present invention.

FIG. 1 shows a block diagram of an embodiment of the automatic performance apparatus according to the present invention. In this figure, the reference numeral 1 refers to a CPU (central processing unit) which controls every part of the apparatus connected via the bus 11. The details of the operation of the CPU 1 will be given later. The reference numeral 2 designates a ROM (read only memory) which stores control programs and pattern data (described later) and other data for the CPU 1. The numeral 3 designates a RAM (read and write memory) which is a work area for the CPU 1, and serves as a temporary memory for storing computed results, register values, as well as pattern data and song data (described later) programmed by the user.

Figure 2:
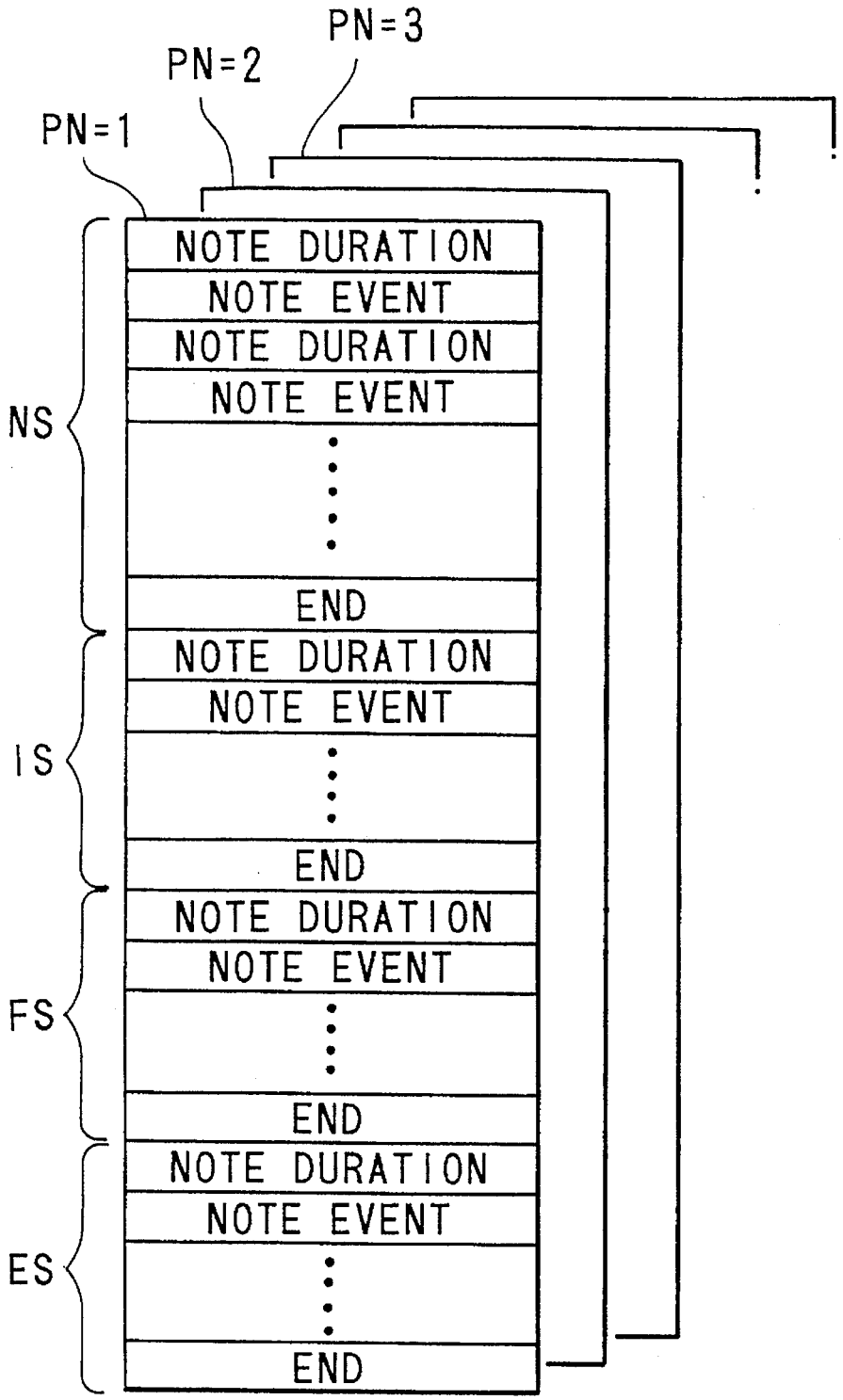
FIG. 2 shows an example of the data format for the pattern data in the embodiment.

Here, the pattern data represents the accompaniment patterns during one or several bars, and FIG. 2 shows an example of the pattern data based on the rhythm pattern. As shown in this figure, the pattern data consists of four sections: the normal section NS which is repeatedly used throughout the performance; the introduction section IS which is used during the introduction portion of the performance; the fill-in section FS which is inserted in the middle portion of the performance; and the ending section ES which is used in the ending portion of the performance.

Each of these sections consists of: note event data including a note number which specifies the type of percussion instrument tone to be generated, and the velocity data which expresses the intensity of the tone and other data; and the duration data (referred to as the note duration hereinbelow) which expresses the time interval between the note events. The note duration determines the timing for the rhythm tone generation. At the end of each section, end data is added for separating the various sections. In the ROM 2, there is a plurality of such pattern data, and each pattern data is assigned a pattern number PN.

In the meantime, the song data is data for expressing the order of performance based on the pattern data, and are memorized, for example, in the format shown in FIG. 3. The song data consists of the header section which contains information to be specified at the start of performance such as tempo, pattern, initial values of various sections; event data which contains information representing pattern changes after the performance has started; and duration data (referred to as song duration) which contains information on the time interval between the events. The song duration determines the timing for the event data generation. The event data contains such data as pattern numbers which represent the type of patterns, section numbers which represent the type of sections such as normal section and introduction section, and tempo data which represents changes in tempo.

Here, the minimum unit of time interval for performing the same pattern is one bar. Therefore, the song duration data is constructed so that the timing for the pattern changes coincide with the timing of the bar lines.

Returning to FIG. 1, the configuration of the embodiment will be explained further. In this figure, the reference numeral 4 refers to a timer which generates an interrupt signal to be supplied to the CPU 1. The CPU 1 carries out timer interrupt processing (to be described later) in accordance with the interrupt signal supplied from the timer 4. The timing interval of the timer 4 corresponds to 1/24 of the quarter note length, for example, and is decided in accordance with the specified tempo.

The reference numeral 5 refers to panel switches such as starting/stopping switch, ALL repeat switch, AB switch (to be described later) and others. The ON/OFF state of the switches is determined by the switching detection circuit 6, and the detected signal is supplied to CPU 1.

At this point, the main switches (not shown) comprising the panel switch 5 will be explained. First, the starting/stopping switch is a command switch for starting and ending an automatic performance. The ALL repeat switch is a command switch for repeating all of the performance, that is from the beginning of a tune to its end, and the AB switch is for specifying the range and the like to be repeated within a tune sequence. Using the ALL repeat switch and the AB switch, three types of performance, such as those shown in FIG. 4, can be performed. The three performance sequences will be explained below.

First, when the ALL repeat switch is turned on, a tune is repeated from its beginning to the end, as shown in FIG. 4 (A). When the AB switch is operated, while the ALL repeat performance is being carried out, two different points A and B are specified as shown in FIG. 4 (B). Then, the performing location in the tune sequence reaches point B, it returns from point B to point A, after which the sequence between the points A and B will be repeated.

Further, FIG. 4 (C) shows a case in which, while the ALL repeat performance is being carried out, the AB switch is operated to first specify a point A followed by a second operation of the AB switch to specify a point B that is located closer to the start of the tune. Then the performing location in the tune sequence jumps from point B to point A. Therefore, under this specification condition, the performance is repeated from the start of the tune, always leaving out the portion of the tune sequence between the points A and B. Henceforth, the types of repeated performances illustrated in FIGS. 4 (B) and (C) will be referred to as an AB repeat operation.

Other switch configurations for the panel switch 5 are a pattern switch for specifying a pattern number, a section switch for specifying a section number, a tone color switch for specifying a tone color, a tempo switch for specifying a tempo of the performance, and a song record switch to command recording song data.

Returning to FIG. 1, the construction of the embodiment will be explained. In this figure, the reference numeral 7 refers to a display circuit. The display circuit 7 converts various data supplied by the CPU 1 to a format which can be displayed, and displays the data on a display unit (not shown).

The reference numeral 8 refers to a tone generator circuit. The tone generator circuit 8 generates a tone in accordance with the performance data supplied by the CPU 1 such as note event data. The digital musical signal generated by the tone generator circuit 8 is converted by the D/A (digital to analogue) converter 9 which supplies analogue data to a sound system 10. The sound system 10 carries out filtering processing, such as eliminating noises from the musical signal supplied by the D/A converter 9, and amplifies the musical signal. The musical signal will be outputted as a tune from speakers.

(B) Operation of the Embodiment

Next, the operation of the embodiment of the above construction will be explained with reference to the flow charts shown in FIGS. 5 to 9.

(B-1) Overall Operation

Figure 5:
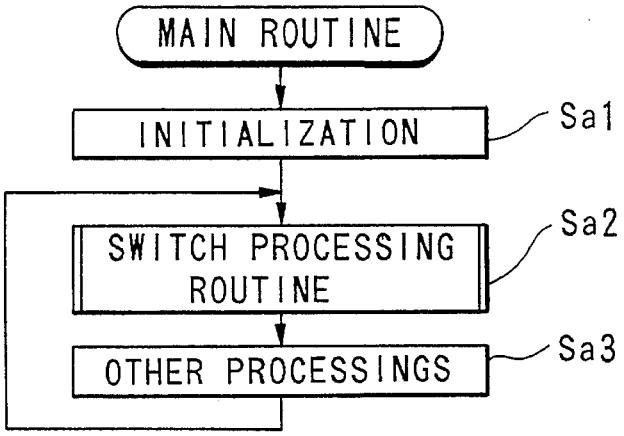
FIG. 5 shows a flow chart of the main routine in the control program for the CPU.

First, when the power to the apparatus is turned on, the CPU 1 loads the control programs from the ROM 2. The main processing routine shown in FIG. 5 is activated, and the program proceeds to step Sa1. In step Sa1, various registers are initialized. In step Sa2, the CPU 1 activates the switch processing routine and carries out processing in accordance with operations for the various switches on the panel switch 5. The details of the switch processing routine will be explained later.

Next, in step Sa3, the CPU 1 carries out various tasks such as displaying, and returns to step Sa2. Unless there is an interrupt signal from the timer 4, the CPU 1 repeats the steps Sa2, Sa3. When an interrupt signal is supplied from the timer 4, the CPU 1 activates the timer interrupt processing routine, reads out pattern data and song data, and generates instructions on tone generation. The details of the timer interrupt processing routine will be explained later.

(B-2) Switch Processing

Figure 6:
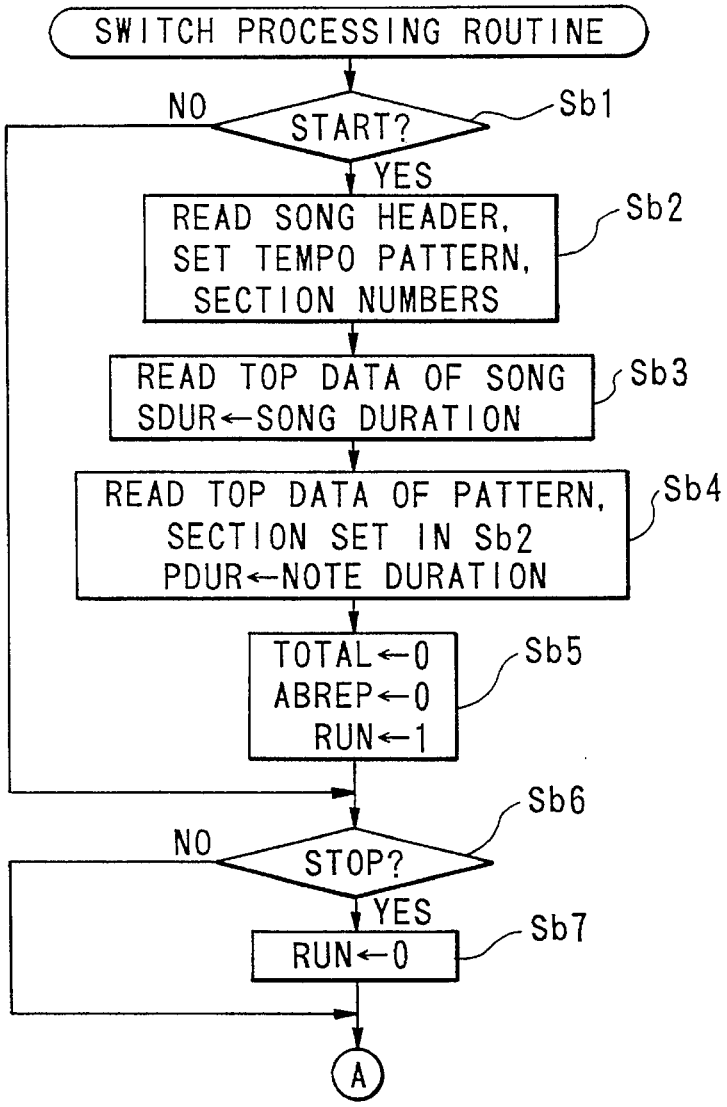
FIGS. 6 and 7 show flow charts of the switch scanning processing in the control program for the CPU.
Figure 7:
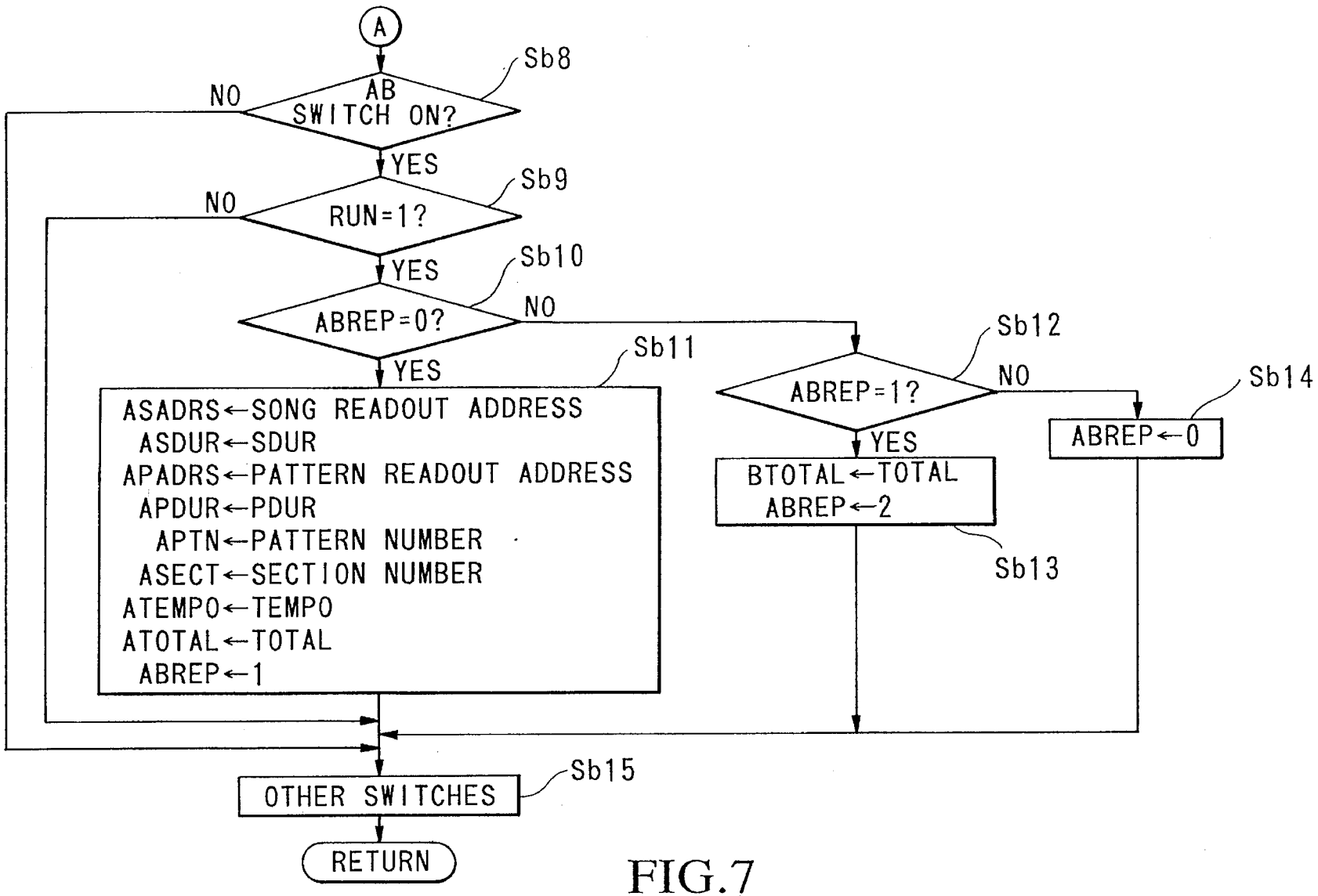

The details of the switch processing are as follows. In step Sa2 (refer to FIG. 5), when the switch processing routine shown in FIGS. 6 and 7 is activated, the CPU 1 proceeds to step Sb1 of this routine (refer to FIG. 6 henceforth). In step Sb1, it the CPU 1 determines if the starting/stopping switch has been activated to command that the automatic performance should be commenced.

If the automatic performance is indicated, the result is [Yes], and the CPU 1 proceeds to step Sb2. In step Sb2, the header section of the song data is read out. In the header section, the initial values of tempo, pattern and section are stored, and tempo, pattern and section will be set in accordance with these values. Proceeding to step Sb3, the CPU 1 reads out the song duration data present in the top portion of the song data, and inputs the data in the register SDUR. Here, the value of the register SDUR is decremented every time the timer interrupt processing is carried out at regular time intervals, thus making it possible to memorize the residual time of the song duration at the current performance location.

Proceeding to step Sb4, the CPU 1 reads out the note duration data which is at the top portion in the pattern data corresponding to the pattern and section set in step Sb2, and inputs the data into the register PDUR. Here, the value of the register PDUR is also decremented every time the timer interrupt processing routine is carried out, thus memorizing the residual time of the note duration at the current performance location.

Proceeding to step SbS, the register TOTAL and the flag ABREP are cleared to [0]. The register TOTAL is a register to memorize the elapsed time from the start of the tune, which is incremented every time the timer interrupt processing is carried out.

The flag ABREP is a flag register to memorize the state of the performance before the AB switch is activated. That is, if the AB switch is turned on when the flag is [0], the point A is specified and the flag changes to [1]. If the AB switch is turned on when the flag is [1], then the point B is specified, AB repeat is executed and the flag changes to [2]. If the AB switch is turned on when the flag is [2], the AB repeat operation is cancelled and the flag changes to [0]. Further in step Sb5, the flag RUN, which shows whether or not the automatic performance is being executed, is set to [1] to indicate that the automatic performance is in progress.

Proceeding to step Sb6, the CPU 1 determines if the cancelling of automatic performance has been commanded by the starting/stopping switch. In this case, the instruction to commence automatic performance is in effect from step Sb1. The result is [No], and the CPU 1 proceeds to step Sb8 rather than to step Sb7.

In the meantime, in step Sb1, if the cancelling of automatic performance had been issued, the result would be [No], and instead of carrying out the above steps Sb2–Sb5, the CPU 1 proceeds directly to step Sb6. In step Sb6, the result would be [Yes], and it proceeds to step Sb7. In step Sb7, the flag RUN is set to [0] to indicate that the automatic performance is not in progress.

Proceeding to step Sb8 (henceforth refer to FIG. 7), the CPU 1 scans the AB switch, and determines whether the AB switch has been activated. If the AB switch is activated, the result is [Yes], and the CPU 1 proceeds to step Sb9. In step Sb9, the CPU 1 determines if the value of the flag RUN is [1]. In this embodiment, this procedure is adopted so that the AB switch is effective only when the automatic performance is being executed.

If the automatic performance is on and the value of the flag RUN is [1], the result is [Yes] and the CPU 1 proceeds to step Sb10. In step Sb10, the CPU 1 examines if the value of the flag ABREP is [0], that is, the CPU 1 determines whether or not the AB switch operation being made this time indicates the point A.

In this case, if the value of the flag ABREP is [0], the result is [Yes], and the CPU 1 proceeds to step Sb11. In step Sb11, the CPU 1 carries out the following processing (a) to (h), depending on the instructions at the point A, and then CPU 1 proceeds to step Sb15. The processing steps (a) to (i) are as follows:

(a) the readout address for the song data at the current performance location is inputted in the register ASADRS;

(b) the value of the register SDUR which indicates the residual time for the song duration at the current performance location is inputted in the register ASDUR;

(c) the readout address for the pattern data at the current performance location is inputted in the register APADRS;

(d) the value of the register PDUR which indicates the residual time for the note duration at the current performance location is inputted in the register APDUR;

(e) the pattern number being specified at the current performance location is inputted in the register APTN;

(f) the section number being specified at the current performance location is inputted in the register ASECT;

(g) the current value of the register TOTAL which indicated the elapsed time from the start of the tune is inputted in the register ATOTAL and;

(h) the flag ABREP is set to [1]; and (i) the tempo being specified at the current performance location is registered in the register ATEMPO.

In the meantime, in step Sb10, if the value of the flag ABREP is not [0], the result is [No] and the CPU 1 proceeds to step Sb12. In step Sb12, the CPU 1 determines if the value of the flag ABREP is [1]; i.e., the AB switch operation being made this time indicates the point B or not.

If the value of the flag ABREP is [1], the result is [Yes], and the CPU 1 proceeds to step Sb13. In step Sb13, the tasks corresponding to the operational instructions at the point B are carried out. In other words, the value of the register TOTAL at the current performance location is inputted in the register BTOTAL, and the flag ABREP is set to [2]. The CPU 1 then proceeds to step Sb15.

If in step Sb12, the value of the flag ABREP is not [1] but [2], the result is [No] and the CPU 1 proceeds to step Sb14. In step Sb14, because the operation of the AB switch in this case corresponds to cancellation of AB repeat, the register ABREP is set to [0], and the CPU 1 proceeds to step Sb15.

In the previously described step Sb8, if there has been no operational event for the AB switch, the result is [No], and the CPU 1 proceeds directly to step Sb15 without performing the tasks corresponding to the steps Sb9 to Sb14.

In step Sb1S, the CPU 1 carries out tasks corresponding to the switches operated such as the ALL repeat switch and tempo switch. At this point, the switch processing routine is completed and the CPU 1 returns to the main routine (refer to FIG. 5).

As described above, every time the CPU 1 proceeds to Sa2, the switch processing routine is activated, and switch operating tasks such as the starting/stopping and AB switching are carried out.

(B-3) Timer Interrupt Processing Details

Figure 8:
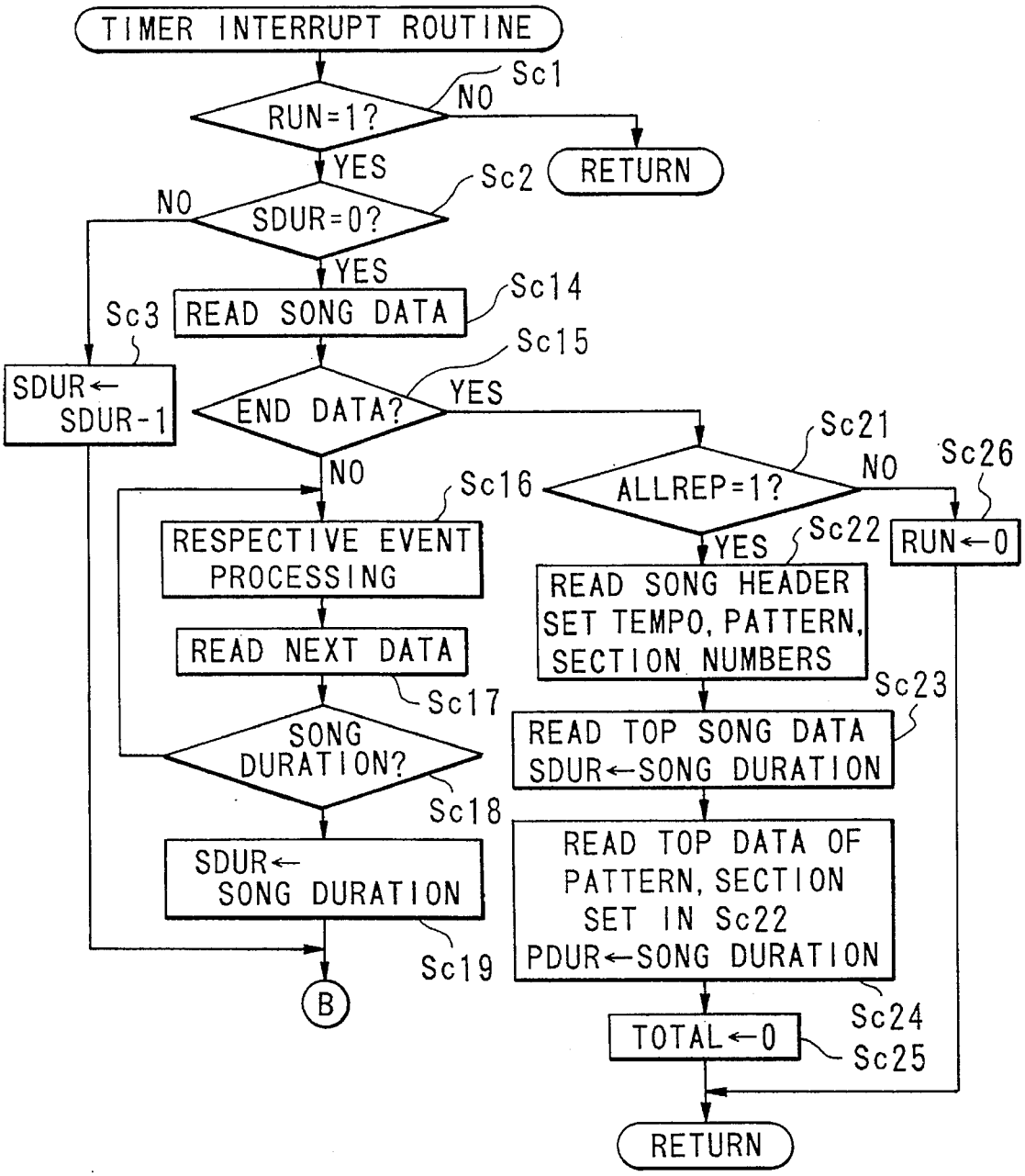
FIGS. 8 and 9 show flow charts of the timer interrupt routine in the control program for the CPU.
Figure 9:
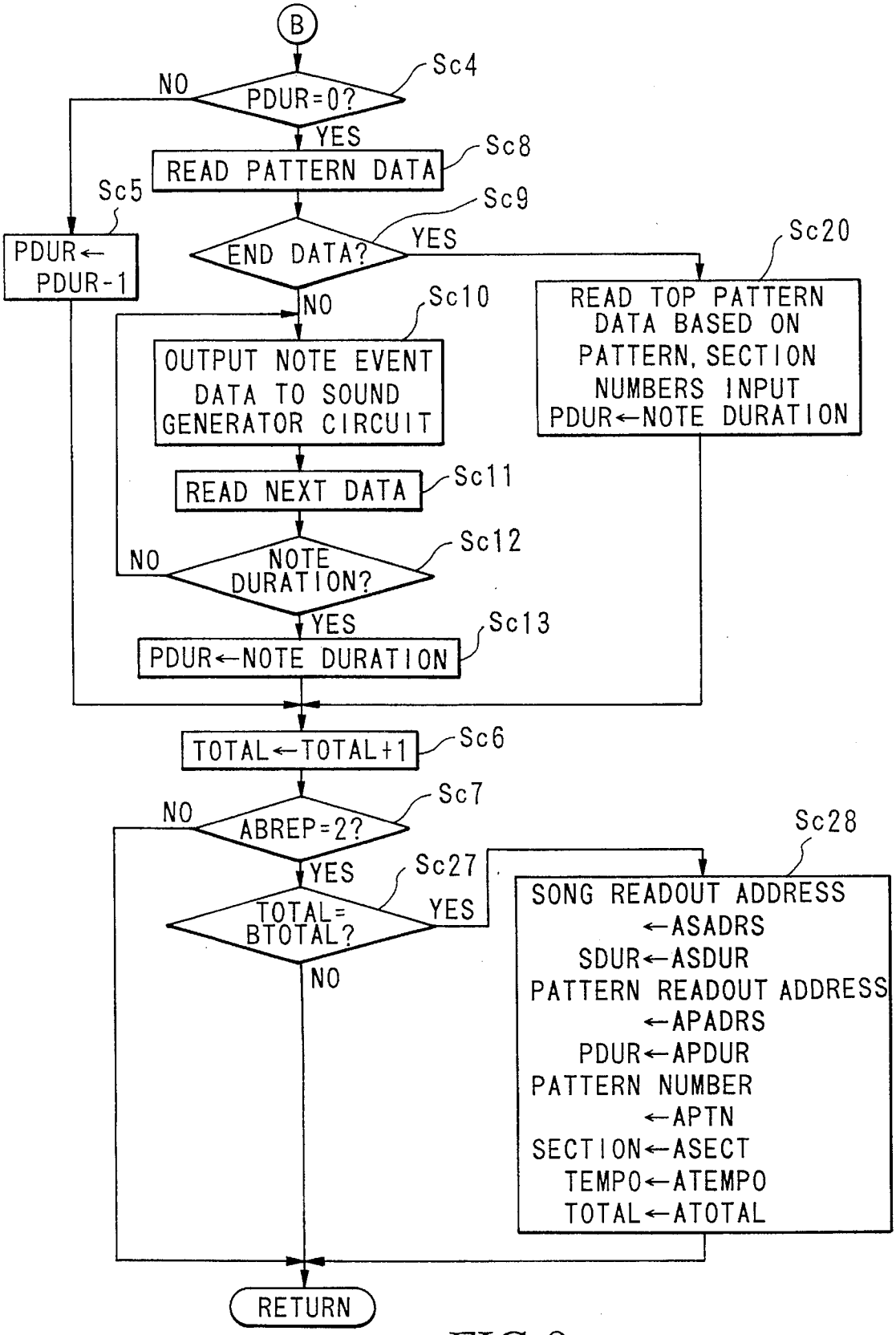

Each time the timer 4 supplies an interrupt signal at specific intervals to CPU 1, the CPU 1 activates the timer interrupt processing routine shown in FIGS. 8 and 9. The following explanations are divided into processing routes (1) to (5) which are carried out regardless of the presence or absence of an AB repeat command, and processing route (6) which is carried out only when there is an AB repeat command.

(1) Steps Until the Note Duration Passes

When the timer interrupt processing routine is activated, the CPU 1 proceeds to step Sc1 (henceforth refer to FIG. 8). In step Sc1, the CPU determines if the value of the flag RUN is [1]. If the automatic performance is in progress and the value of the flag RUN is [1], the result is [Yes], and the CPU 1 proceeds to Sc2. In step Sc2, the CPU 1 determines if the value of the register SDUR is [0]. That is, the CPU 1 determines if the time interval corresponding to the song duration has passed, depending on whether the value of the register SDUR, which is decremented in step Sc3, has become [0] or not. The details of step Sc3 will be described later.

If the time interval corresponding to the song duration has not passed, the result is [No], and the CPU 1 proceeds to step Sc3. In step Sc3, the register SDUR is decremented by [1]. Proceeding to step Sc4 (henceforth refer to FIG. 9), the CPU 1 determines if the value of the register PDUR is [0]. That is, in this case, whether the time interval corresponding to the note duration has passed or not depending on whether the value of the register PDUR has become [0] or not. The step Sc5 will be described later.

If the time corresponding to the note duration has not passed, the result is [No], and the CPU 1 proceeds to step Sc5. In step Sc5, the register PDUR is decremented by [1]. Proceeding to step Sc6, the CPU 1 increments the register TOTAL by [1]. By this step, the elapsed time from the start of the tune is registered. Processing to step Sc7, the CPU 1 determines if the value of the flag ABREP is [2], i.e. whether the AB repeat has been commanded by the AB switch.

If the AB repeat is not commanded, the result is [No], and the CPU 1 completes the processing in this routine, and returns to the main routine (refer to FIG. 5). Accordingly, each time the interrupt interval appropriate to the tempo passes, the timer interrupt processing routine is activated and repeats steps Sc1–Sc7 until either the song duration or the note duration passes.

(2) Steps After the Note Duration Passes

After the time interval equal to the note duration has passed, the result in step Sc4 (henceforth refer to FIG. 9) becomes [Yes], the CPU 1 proceeds to step Sc8. In step Sc8, the specified pattern data is read out. Proceeding to step Sc9, the CPU 1 determines if the readout data is end data that indicates the ending of the section ES.

If the readout data is not the end data but is note event data, the result is [No], and the CPU 1 proceeds to step Sc10. In step Sc10, the readout note event data, i.e. the note number and the velocity data, are outputted to the tone generator circuit 8. Then, the tone generator circuit 8 generates a tone signal for the percussion instrument corresponding to the note number at a sound intensity corresponding to the velocity data. The tone signal is supplied to the sound system 10 through the D/A converter 9, and is outputted as a tone.

Processing to step Sc11, the data next to the specified pattern data is read out. Then in step Sc12, the CPU 1 determines if the readout data is the note duration data. If the readout data is note event data instead of note duration data, the result is [No], and the CPU 1 returns to step Sc10 to repeat the tone generation processing. In other words, all of the note event data to be generated at the same time is outputted to the tone generation circuit 8. Thus, until the next note duration data is read out, CPU 1 repeats the processing steps Sc10–Sc12.

When the next note duration data is read out, the result of the determination is step Sc12 becomes [Yes], and it proceeds to step Sc13. In step Sc13, the readout duration data is inputted in the register PDUR and is considered to be the note duration which indicates the time interval for the next note event. The CPU 1 then proceeds to steps Sc6, Sc7, and if the AB repeat is not specified, the CPU 1 completes the time interrupt routine, and returns to the main routine (FIG. 5).

Accordingly, the steps Sc8–Sc13 are repeated for each passing of the time interval for the note duration, until either the time interval corresponding to the song duration passes or the end data indicating the end of the pattern section is read out.

(3) Processing Steps After the Song Duration Passes

When the time interval corresponding to the song duration passes, the result of determination in step Sc2 (henceforth refer to FIG. 8) becomes [Yes], and the CPU 1 proceeds to step Sc14. In step Sc14, song data is read out. Proceeding to step Sc15, the CPU 1 determines if the readout data is the end data indicating the end of the song data, i.e. the end of the tune.

When the readout data is not the end data but is an event data, the result is [No], and the CPU 1 proceeds to step Sc16. In step Sc 16, processing corresponding to the type of event indicated by the event data is carried out. In other words, if the event data is the pattern number, the reading location is moved to the top address in the pattern data for the indicated pattern number, and the note duration data which is at the top portion in the section is read out and inputted in the register PDUR.

When the event data is the section number, the readout location is moved to the address corresponding to the current timing of the section to correspond with the section number, and the residual time of the note duration to the next note event is calculated, and this value is inputted in the register PDUR. When the event data is the tempo data, the interrupt interval by the timer 4 is set to be compatible with the tempo data. By this step, the performance tempo is changed.

Proceeding to step Sc17, the next data to the song data is read out, and proceeding to step Sc18, the CPU 1 determines if the readout data is the song duration data. If the readout data is not the song duration data, but is the event data, the result is [No], and returns to step Sc16 and continues processing appropriate to the type of event. The CPU 1 repeats the steps Sc16–Sc18 until the next song duration data is read out.

When the next song duration data is read out, the result of determination in step Sc18 becomes [Yes], and the CPU 1 proceeds to step Sc19. In step Sc19, the readout song duration data is inputted in the register SDUR and this data is used as the song duration data for the next event interval, and this data, After carrying out the steps subsequent to the step Sc4, CPU 1 completes this routine and returns to the main routine (FIG. 5). Accordingly, each time the time interval equivalent to the song duration passes, the above-described steps Sc14–Sc19 of the timer interrupt processing routine are carried out.

(4) Processing Steps After the Readout of End Data of Sections

When the end data indicating the end of the section of the specified pattern data section occurs, the decision in the above-described step Sc9 (henceforth FIG. 9) becomes [Yes], and CPU 1 proceeds to step Sc20. In step Sc 20, processing appropriate to the specified type of the section is carried out.

In more detail, if the normal section is specified, the reading location is returned to the top address of the section. The note duration data which is at the top portion is read out, and is inputted in the register PDUR. Subsequently, the CPU 1 repeats the reading of the normal section of the same pattern data. If either the introduction section or the fill-in section is specified, the reading location is moved to the top address of the normal section of the same pattern data, and the normal duration data which is at the top portion is read out and inputted in the register PDUR. If the ending section is specified, because it indicates the end of the tune, nothing is carried out.

The CPU 1 then proceeds to steps Sc6, Sc7, and if the AB repeat is not specified, the CPU 1 completes this routine, and returns to the main routine (FIG. 5). Accordingly, each time the end data is read out, processing is carried out as in the above-described step Sc20 of the timer interrupt processing routine.

(5) Processing Steps After the End Data of Songs is Read Out

When the automatic performance reaches the end of the tune, and the end data is read out signifying the end of the song data, the decision in the above-described step Sc15 becomes [Yes], and the CPU 1 proceeds to step Sc21. Here, if the ending section is stored in the song data, the end data of the song data is arranged so as to end at the same time as the completion of the ending section in the tune sequence. In step Sc21, the CPU 1 examines if the value of the flag ALLREP is [1], i.e. whether the ALL repeat operation is specified or not. The flag ALLREP is set to [1] by carrying out the ALL repeat-on operation, and is reversed to [0] by carrying out the ALL repeat-off operation.

When the value of the flag ALLREP is [1], the result is [Yes], and the CPU 1 proceeds to step Sc22. In step Sc22, the CPU 1 again reads out the header division of the song data, and the tempo, pattern and section are all reset. Proceeding to step Sc23, the song duration data at the top of the song data is read out and inputted in the register SDUR, and in step Sc24, the CPU 1 reads out the note duration data, inputted in step Sc22, which is at the top portion of the section of the pattern set previously in step SC22, and inputs the note duration data in the register PDUR.

Proceeding to step Sc25, the register TOTAL is reset to [0], the CPU 1 completes this routine and returns to the main routine (FIG. 5). Accordingly, the process described above is repeated to replay the automatic performance of the tune from the beginning.

In the meantime in step Sc21, when the value of the flag ALLREP is not [1], the result becomes [No], and the CPU 1 proceeds to step Sc26. In step Sc26, the flag RUN is reversed to [0] to stop the automatic performance, and the CPU 1 returns to the main routine (FIG. 5). This state is maintained until the CPU 1 receives a command to begin automatic performance by the operation of the starting/stopping switch.

If the automatic performance is not being carried out, the result in step Sc1 becomes [No], and the CPU 1 does nothing in the timer interrupt processing routine, and the CPU 1 returns to the main routine (FIG. 5).

(6) Processing Steps When AB Repeat Operation is Specified

When the AB repeat operation is being specified, the decision in the above-described step Sc7 (henceforth FIG. 9) is [Yes], and the CPU 1 proceeds to step Sc27. In step Sc27, the CPU 1 examines whether or not the value of the register TOTAL and the value of the register BTOTAL assigned in the above-described step Sb13 (refer to FIG. 7) are equal. In other words, in this step, the CPU 1 examines whether the current performance location in the tune sequence coincides with the location B specified by the AB switch.

If there is a discrepancy, the CPU 1 returns to the main routine (FIG. 5) without carrying out any processing. Afterwards, the CPU 1 repeats the described steps until there is a match in the timing of the two locations.

As the automatic performance progresses, and the timing of the current performance location of the tune matches with that of the point B, the result in step Sc27 becomes [Yes], and the CPU 1 proceeds to step Sc28. In step Sc28, to change the current performance location in the tune sequence to point A, the following steps (a) to (h) are carried out using the data from the above-described step Sb11 (FIG. 7).

(a) The value of the register ASADRS is specified as the readout address of the song data.

(b) The value of the register ASDUR is inputted in the register SDUR.

(c) The value of the register APADRS is specified as the readout address of the pattern data.

(d) The value of the register APDUR is inputted in the register PDUR.

(e) The value of the register APTN is specified as the pattern number.

(f) The value of the register ASECT is specified as the section number.

(g) The value of the register ATEMPO is specified as the tempo.

(h) The value of the register ATOTAL is inputted in the register TOTAL.

Figure 10:
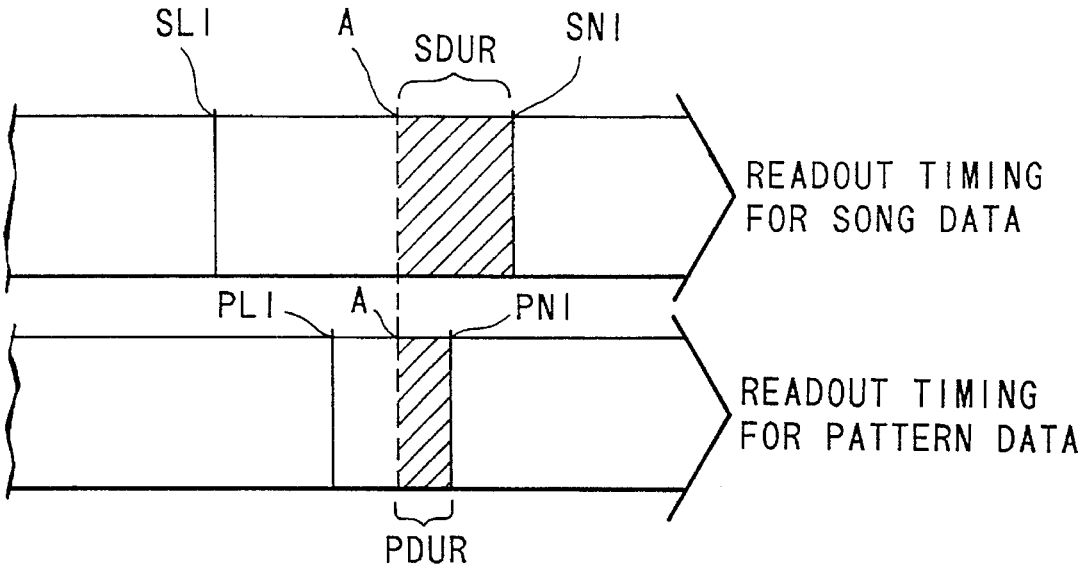
FIG. 10 shows the relationship between a specified point A and the song data timing, and the pattern data timing when an AB repeat operation is specified.

By carrying out the above steps, the pattern, the specification of the section and the tempo, as well as the read out addresses for the song data and pattern data, are set the same as those when the point A was specified. This is explained graphically in FIG. 10 in terms of the song data readout timing and pattern data readout timing arranged in the direction of the tune sequence. Suppose a point A is specified while the automatic performance is in progress at the current song data performance location SLI. Then, the readout timing for the next song data SNI is advanced by the value of the register SDUR, which is the residual time to the next song data SNI. The readout timing for the pattern data is determined similarly in terms of the current note event timing, PLI, point A timing and the next note event timing PNI, and is advanced by the value of the register PDUR, which is the residual time for the next note event timing PNI.

Accordingly, when the current performance location in the tune sequence reaches point B timing, while the apparatus is in the automatic performance, the current performance location is changed to point A. Therefore, as previously shown in FIG. 4 (B), when points A and B are specified in the tune, the tune sequence returns from point B to point A, and afterwards the CPU 1 repeats performance between points A, B. Also, as was shown in FIG. 4 (C), if point B is set back closer to the start of the tune while ALL repeat is being carried out, when the current performance location in tune sequence reaches the point B, the current performance point always jumps from point B to point A.

(C) Variations of the Embodiment

The above embodiment concerned repeat performance or jump performance of the pattern sequencer; however, it is also possible to specify any location in a tune, and start the automatic performance from the specified location.

The pattern data is not limited to the rhythm pattern which was shown in FIG. 2. The bass pattern or the chord backing pattern may also be used. In this case, chord data are included in the song data, and the tone pitch of the note data can be modified in accordance with the readout chord data in the bass pattern or chord backing pattern.

Also, the repeat performance or jump performance of the above embodiment is not limited to the pattern sequencer, and it is possible to adapt the invented arrangement to the regular automatic performance apparatus which plays by memorizing the note events from the start to the end of a tune, for example. In such cases, not only the note event data but tone altering data may also be memorized, and the altered tone may be reproduced after the current performance location is moved to another location by repeat or jump performance.

Also, the pattern data and the song data can be constructed in any format. In the above embodiment, the form was "event+intervals between events (duration)". Other format such as "event+event generation timing within a bar" may be used. It is also possible to store the performances sequences in addresses in a memory, and each address may be provided with an identifier to indicate the presence or absence of an event.

Figure 11A:
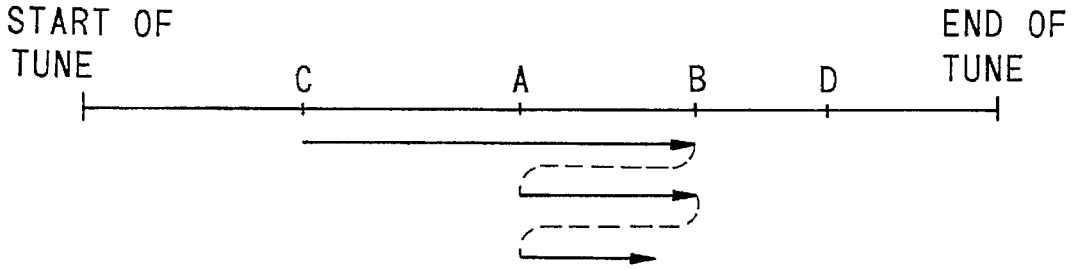
FIG. 11 (A) shows an application variation of the AB repeat operation of the embodiment, and FIG. 11 (B) shows another application variation of the AB repeat operation of the embodiment.
Figure 11B:
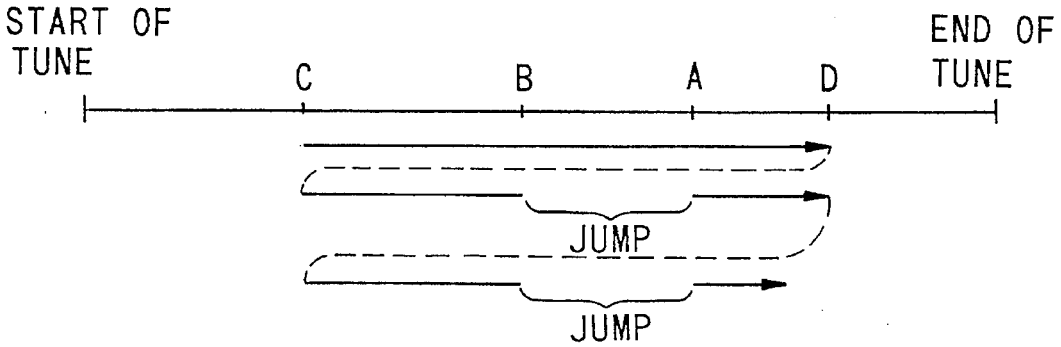

Further, the invention is not limited to repeat automatic performance such as AB repeat in one tune, and other performances such as those shown in FIG. 11 are also possible. A range such as between point C and point D may be specified, and AB repeat operation can be performed within this range CD as shown in FIG. 11(A) or jump performance as shown in FIG. 11(B).

Further, the invention is not limited to the specification of the location of AB repeat operation as in the above embodiment, and the position of bars and the timing within the bars may be specified, for example, before playing the automatic performance by such means as a numerical keyboard. In this case, computation may be carried out to calculate the memory locations and the timing to the next event.

What is claimed is:

1. An automatic performance apparatus for playing a tune by sequentially reading performance data stored in memory, comprising:

(a) memory means for storing performance data in an order of a tune sequence;

(b) readout means for repeatedly reading out performance data from said memory means over a given range of locations in said tune sequence;

(c) location specifying means for freely specifying a first location and a second location to define a specific range of locations within said given range of locations, wherein the second location may be before or after the first location; and (d) readout control means for moving the reading location of performance data, from said second location to said first location, when the reading location of the performance data read out by said readout means coincides with said second location, wherein only those locations within the specific range defined by the first and second locations are read out and played.

2. An apparatus as claimed in claim 1, wherein said given range of locations is from the start of said tune sequence to the end of said tune sequence.

3. An apparatus as claimed in claim 1, wherein said location specifying means specifies said first location and said second location while said readout means is reading out the performance data.

4. An apparatus as claimed in claim 1, wherein said readout control means includes address memory means for storing an address in said memory means that corresponds with performance data for said first location, and changes the readout address to said address when the reading location reaches said second location.

5. An apparatus as claimed in claim 1, wherein said apparatus further includes:

state memory means for storing the performance state corresponding to said first location; and reproduction means for reproducing the performance state when the readout control means moves the reading location to said first location.

6. An automatic performance apparatus, for playing a tune sequence by sequentially reading performance data stored in memory, comprising:

(a) first memory means for storing a plurality of pattern data consisting of a note event which represents a tone generation event and a generation timing which represents the generation timing of said note event;

(b) second memory means for storing song data which represent the order of performance of said plurality of pattern data in an order of said tune sequence;

(c) readout means for reading out said song data in the order of said tune sequence from said second memory means, and for reading out pattern data from said first memory means in accordance with said song data;

(d) location specifying means for freely specifying two or more desired locations within said tune sequence, wherein at least one of the two or more desired locations is a starting location and at least one other of the two or more desired locations is an ending location;

(e) third memory means for storing a memory location of song data in said second memory means to correspond with each of the two or more desired locations specified by said specifying means, and, based on the timing of each desired location, for deducing time data concerning a specific timing of next pattern data immediately subsequent to each desired location, and storing said time data;

(f) fourth memory means for storing a memory location of said pattern data in said first memory means to correspond with each of the two or more desired locations, and, based on the timing of each desired location, for deducing time data concerning a specific readout timing of a next note event immediately subsequent to each desired location, and storing said time data;

(g) readout control means for controlling the readout operations of said readout means in accordance with each of the memory locations and the time data stored in said third memory means and said fourth memory means, wherein each of the two or more desired locations may be set independently of the other two or more desired locations such that the ending location may be before or after the starting location, and wherein only locations between specified desired locations are read out and played such that it is possible to start the tune sequence from any specified desired location and to repeat pattern sequences stored in said forth memory means.

7. An apparatus as claimed in claim 6, said generation timing stored in said first memory means represents duration data defining a time interval between note events, and said readout means reads out a note event for each passing of the duration time associated with said duration data.

8. An apparatus as claimed in claim 7, wherein said readout means comprises counting means for counting the time indicated by said duration data, and said fourth memory means stores a readout address of said first memory means read out by said readout means as well as a counted value of said counting means.

9. An apparatus as claimed in claim 6, wherein said song data stored in said second memory means comprises pattern altering event data and timing data representing the generation timing for said pattern altering event data.

10. An apparatus as claimed in claim 9, wherein said readout means comprises counting means for counting the time shown by said timing data, and said third memory means stores a readout address for said second memory means read out by said readout means as well as the counted values of said counting means.

11. An apparatus as claimed in claim 6, wherein said location specifying means specifying a performance start location of a repeat performance in said tune sequence.

12. An apparatus as claimed in claim 6, wherein said apparatus further includes:

performance state memory means for storing the performance state at the location specified by said location specifying means; and reproduction means for reproducing the memorized performance state.

13. An automatic performance apparatus for playing a tune by sequentially reading performance data stored in memory, the apparatus comprising:

a memory that stores performance data in an order of a tune sequence;

a readout device that repeatedly reads out the performance data from the memory over a given range of locations in the tune sequence;

a location specifying device that freely specifies a starting location and an ending location to define a specific range of locations within the given range of locations, wherein the ending location occurs before the starting location; and a readout control device that moves the read out location of the performance data from the ending location to the starting location, when the read out location of the performance data read out by the readout device coincides with the ending location such that locations between the ending and starting locations are jumped over by the read out device and only those locations within the specific range defined by the starting and ending locations are read out and played.

14. An apparatus according to claim 13, wherein the given range of locations is from the start of the tune sequence to the end of the tune sequence.

15. An apparatus according to claim 13, wherein the location specifying device specifies the starting location and the ending location while the readout device is reading out the performance data.

16. An apparatus according to claim 13, wherein the readout control device includes address memory means for storing an address in the memory device that corresponds with performance data for the starting location, and changes the readout address to the address when the reading location reaches the ending location.

17. An apparatus according to claim 13, wherein the apparatus further includes:

state memory means for storing the performance state corresponding to the starting location; and reproduction means for reproducing the performance state when the readout control device moves the reading location to the starting location.

* * * * *